US005579542A

United States Patent [19]

Hayman

[11] Patent Number: 5,579,542

[45] Date of Patent: Dec. 3, 1996

[54] TOILET WITH WATER SAVING, VACUUM-ASSISTED FLUSHING APPARATUS AND ASSOCIATED METHODS

[75] Inventor: Dennis J. Hayman, Plano, Tex.

[73] Assignee: Eljer Manufacturing, Inc., Dallas, Tex.

[21] Appl. No.: 393,174

[22] Filed: Feb. 23, 1995

[51] Int. Cl.[6] ..... E03D 1/12; E03D 1/24

[52] U.S. Cl. ..... 4/374; 4/328; 4/415; 4/329

[58] Field of Search ..... 4/374, 328, 329, 4/330, 331, 332, 415

[56] References Cited

U.S. PATENT DOCUMENTS

| | | | |
|---|---|---|---|
| 359,913 | 3/1887 | White | 4/328 |
| 378,664 | 2/1888 | Demarest | 4/328 |
| 4,041,554 | 8/1977 | Gregory et al. | 4/10 |
| 4,115,883 | 9/1978 | Dauvergne | 4/362 |
| 4,275,470 | 6/1981 | Badger et al. | 4/316 |
| 4,376,315 | 3/1983 | Badger et al. | 4/431 |
| 4,408,361 | 10/1983 | Rozek | 4/331 |
| 4,918,763 | 4/1990 | Brotcke | 4/331 |
| 5,142,712 | 9/1992 | Hennessy | 4/328 |
| 5,165,457 | 11/1992 | Olin et al. | 4/300 |
| 5,406,652 | 4/1995 | Hennessy | 4/362 |

*Primary Examiner*—Henry J. Recla
*Assistant Examiner*—Charles R. Eloshway
*Attorney, Agent, or Firm*—Catherine E. Bracken; J. Richard Konneker; Marlin R. Smith

[57] ABSTRACT

A tank type toilet has a water saving, vacuum-assisted flushing system that incorporates a diverter valve disposed in the tank portion of the toilet. During the flushing of the toilet, pressurized water is discharged from a ballcock valve assembly in the tank and delivered to the diverter valve which creates from the received water a water jet that is used to create a vacuum area within the diverter valve. The vacuum area is communicated with an uppermost interior portion of the bowl trapway to facilitate a main flushing action in the bowl that requires less flushing water. At the same time, the water jet entrains tank water therein, through water inlet openings in the diverter valve body, and delivers the jet and entrained water to the rim flushing passage of the bowl to augment the vacuum-assisted main flushing action. When the tank water level falls to a predetermined level, a float assembly on the diverter valve acts through a poppet valve therein to terminate the jet and divert water flow through the diverter valve to refill the tank and bowl, thereby readying the toilet for another flush cycle.

14 Claims, 3 Drawing Sheets

TOILET WITH WATER SAVING, VACUUM-ASSISTED FLUSHING APPARATUS AND ASSOCIATED METHODS

BACKGROUND OF THE INVENTION

The present invention generally relates to toilet apparatus and, in a preferred embodiment thereof, more particularly relates to flushing systems for tank type toilets.

Conventional toilets for residential use typically include a bowl having a bottom outlet opening, a trapway communicating with the bottom outlet opening and forming therewith a flushing discharge passage from the bowl, and a water holding tank positioned behind and adjacent the bowl. In the "low tank one piece" version of the toilet, the tank is formed integrally with the bowl and has a top side positioned only a relatively short distance higher than the top side of the bowl. In the "high tank two piece" version of the toilet, the tank is formed separately from the bowl and has a top side considerably higher than its low tank counterpart.

In toilets of conventional low tank, one piece construction and operation, flushing of the toilet is typically initiated by rotating and then releasing a handle externally mounted on the tank to, in turn, upwardly rotate and then release a trip lever disposed within the tank and connected by a chain to a flapper member covering and sealing an open inlet seat portion of a flushing passageway routed from the interior of the tank to the interior of the bowl. Rotation and release of the trip lever momentarily raises the flapper member from the flushing passageway inlet seat, thereby permitting a quantity of tank water to flow through the passageway into a lower portion of the bowl to create a bowl flushing action therein.

At the same time that the tank water is flowing into the bowl via the flushing passageway, a float within the tank begins to drop as flushing water exits the tank. The downward movement of the float opens a ballcock valve within the tank which, via a diverter valve and a conduit structure connected thereto, permits pressurized water from an external source thereof to flow into the bowl to create therein a rim flushing action that supplements the bowl flushing action generated by tank water entering the bowl at the same time.

The entry of the bowl flushing and rim flushing water into the bowl rapidly raises the bowl and trapway water levels, thereby creating a trapway siphoning action that flushes water from the bowl. When the water level in the tank downwardly reaches a predetermined level, the diverter valve reroutes the pressurized water supplied thereto via the ballcock valve to refill the tank and the bowl. As the tank is filled, its internal float rises until it shuts off the ballcock valve, thereby readying the toilet for a subsequent flush.

Although residential toilets of this general type previously required about 3.5 gallons of water for each flush, recent federal regulations have reduced the permissible per flush water amount to 1.6 gallons. The need to meet this criteria led to substantial redesigns of tank type toilets and their flushing mechanisms. However, for a variety of reasons, none of these redesigned toilets and associated flushing mechanisms have proven to be entirely satisfactory.

For example, in conjunction with a low tank, one piece toilet, one proposed design for creating a suitably efficient flush using only 1.6 gallons of water has been to reduce the toilet bowl trapway diameter, and install a specially designed inner pressurized water holding flush tank within the larger main flush tank portion of the toilet. After the toilet is flushed, this internal tank is filled with inflowing supply water, via a pressure reduction valve, in a manner such that when the internal tank is filled the water therein is pressurized by a quantity of pressurized air trapped in the internal tank. When the toilet is flushed, 1.6 gallons of pressurized water is forcefully injected into the bowl, the air pressurized water cooperating with the reduced diameter trapway to effect flushing with the mandated reduced volume of water. The use of this pressurized flushing tank concept, despite its effectiveness at reducing flushing water usage, has the decided disadvantages of being noisy and relatively expensive to incorporate into a toilet.

Another approach used to modify a low tank, one piece toilet is to place an electric motor-driven impeller mechanism into the trapway and cause the impeller to forcefully drive the 1.6 gallons of water rapidly through the trapway, in response to the initiation of a flushing cycle, thereby improving the flushing efficiency of the sharply reduced quantity of water discharged from the bowl. This technique has the disadvantages of being complex, requiring an electrical system to be associated with the toilet, and adding considerable cost to the overall cost of the toilet.

A somewhat different approach has been proposed for use in conjunction with a high tank, two piece toilet. In this type of toilet, as in the case of its low tank one piece counterpart, the cross-sectional area of the trapway is substantially reduced. Additionally, the larger tank water head available in the high tank toilet is used to create a gravity-created flushing jet originating on the front interior side of the bowl and directed at the trapway entrance opening.

This approach also has several disadvantages. For example, the need to have the main flushing discharge opening at the front side of the bowl increases casting complexity and cost. Additionally, because gravity-created flushing jet is not as powerful as the flushing jet emanating from the previously described internally pressurized tank, the wash-down performance of this flushing technique tends to be marginal, and the smaller trapway is more prone to clogging.

From the foregoing it can readily be seen that a need exists for a tank type toilet having improved flushing apparatus and methods that operate with a per flush water quantity of 1.6 gallons and eliminate, or at least substantially reduce, the above-mentioned problems, limitations and disadvantages commonly associated with tank type toilets having conventional lowered water quantity flushing systems. It is accordingly an object of the present invention to provide such an improved tank type toilet.

SUMMARY OF THE INVENTION

In carrying out principles of the present invention, in accordance with a preferred embodiment thereof, a tank type toilet is provided with an improved, vacuum-assisted flushing system that permits the toilet to be flushed using only 1.6 gallons of water. Representatively, the toilet is of a low tank, one piece configuration, but the flushing system could also be advantageously be incorporated in other types of toilets, including high tank two piece toilets, as well.

The toilet includes a bowl having an outlet opening, a water holding tank disposed adjacent the bowl, and a trapway communicating with the outlet opening and forming therewith a flushing discharge passage from the bowl. Specially designed flushing means are provided and are selectively operative to flush the toilet. The flushing means include valve means, disposed within the tank and operative to receive pressurized water from a source thereof and responsively creating a jet from the received water, utilize the jet to create a vacuum area within the valve means, and then discharge the received water.

First passage means are provided and are operative to flow the discharged water into the bowl, and second passage means are provided and are operative to communicate the vacuum area with the interior of the trapway in a manner facilitating the flushing of the toilet and reducing its flushing water volume requirement. In a preferred embodiment thereof, the flushing means are further operative to cause the water jet to entrain tank water therein and deliver the entrained tank water therewith to the bowl through the first passage means.

Representatively, the valve means are incorporated in a specially designed diverter valve that is used in conjunction with generally conventional flapper valve and ballcock valve assemblies also disposed in the water holding tank portion of the toilet. In a preferred embodiment of the toilet, the diverter valve vacuum area is communicated with an uppermost portion of the trapway, above its weir portion, and the jet and entrained tank water are delivered to the toilet bowl interior via its rim flushing passage. When the tank water level falls to a predetermined level caused by the flushing operation, a float associated with the diverter valve causes a poppet valve within the diverter valve body to shift away from its spring biased pre-flush position, terminate the formation of the water jet, and divert the incoming pressurized water away from the jet-forming portion of the valve and discharge it for use in refilling the tank and the bowl.

DETAILED DESCRIPTION

Figure 1:
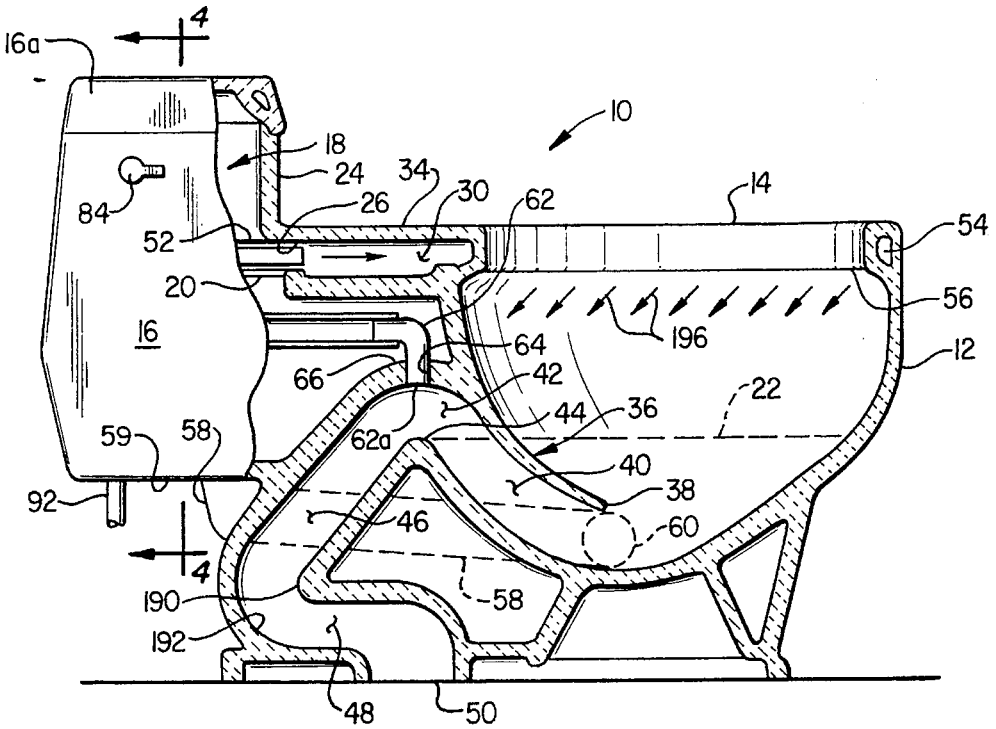
FIG. 1 is a partially sectioned side elevational view of a tank type toilet, representatively a low tank one piece toilet, incorporating therein a specially designed water-saving, vacuum-assisted flushing system embodying principles of the present invention.

Referring initially to FIG. 1, the present invention provides a tank type toilet 10, representatively a low tank, one piece toilet, having a floor supportable bowl 12 with an open top around which a rim 14 extends. A water holding tank 16, having a removable lid 16*a*, is cast integrally with the balance of the toilet, and is disposed behind and projects upwardly beyond the top side of the bowl 12. To facilitate the efficient flushing of the toilet 10 using only 1.6 gallons per flush, the present invention provides a specially designed vacuum-assisted flushing system 18 that is primarily disposed within the tank 16 and which will be illustrated and described in detail subsequently herein.

Toilet 10 is shown in FIG. 1 in a pre-flush mode thereof in which the tank and bowl water levels 20,22 are as indicated. Formed in the front tank wall 24 is an opening 26 that communicates with a chamber 30 disposed in a casting portion 34 positioned between the bowl 12 and the tank 16. A trapway 36 is disposed generally beneath the casting portion 34 and forms a flushing discharge passageway from the bowl 12. Trapway 36 has an inlet opening 38 at a bottom rear portion of the bowl 12, beneath its pre-flushing water line 22; an inlet leg 40 sloping upwardly and rearwardly away from the inlet opening 38; an uppermost interior portion 42 positioned above a weir section 44 of the trapway; an intermediate leg portion 46 sloping downwardly and rearwardly away from the weir 44; and a generally horizontal outlet leg portion 48 extending forwardly from the lower end of the leg portion 46 and having a downwardly facing discharge opening 50 positioned at its forward end and connectable to a sanitary sewer line.

Still referring to FIG. 1, an open outlet end portion of a rim flushing supply conduit 52 extends from the interior of the tank 16 outwardly through the tank wall opening 26 and is sealingly received in the opening 26. The upper chamber 30 communicates with a generally annular interior casting passage 54 that horizontally extends around the rim 14 and has a bottom wall 56 with a circumferentially spaced series of rim flushing openings (not shown) therein. A bottom interior portion of the tank 16 is communicated with the interior of the bowl 12 by means of a bowl passageway 58 connected to the bottom side wall 59 of the tank 16 and having an outlet opening 60 opening outwardly into a lower interior side portion of the bowl 12, adjacent the inlet 38 of the trapway 36, and horizontally facing generally transversely to the length of the trapway 36. For purposes later described, an air suction conduit 62 extends outwardly from the interior of the tank 16 and has an open inlet end 62*a* downwardly and sealingly received in an opening 64 formed in the top wall 66 of the uppermost interior trapway area 42 generally above the weir 44.

Structure of the Vacuum-Assisted Flushing System 18

Figure 2:
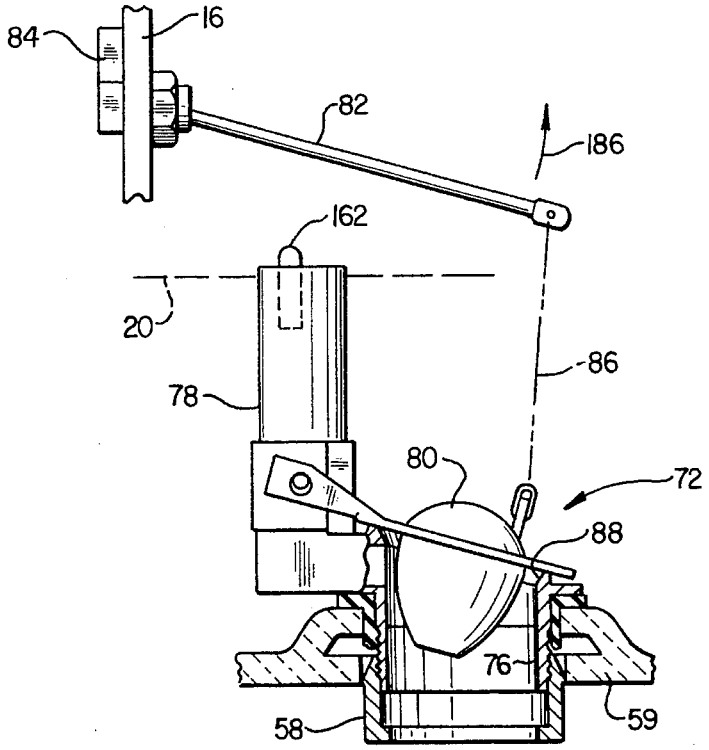
FIG. 2 is an enlarged scale, partially sectioned side elevational view of flapper valve portion of the flushing system.
Figure 3:
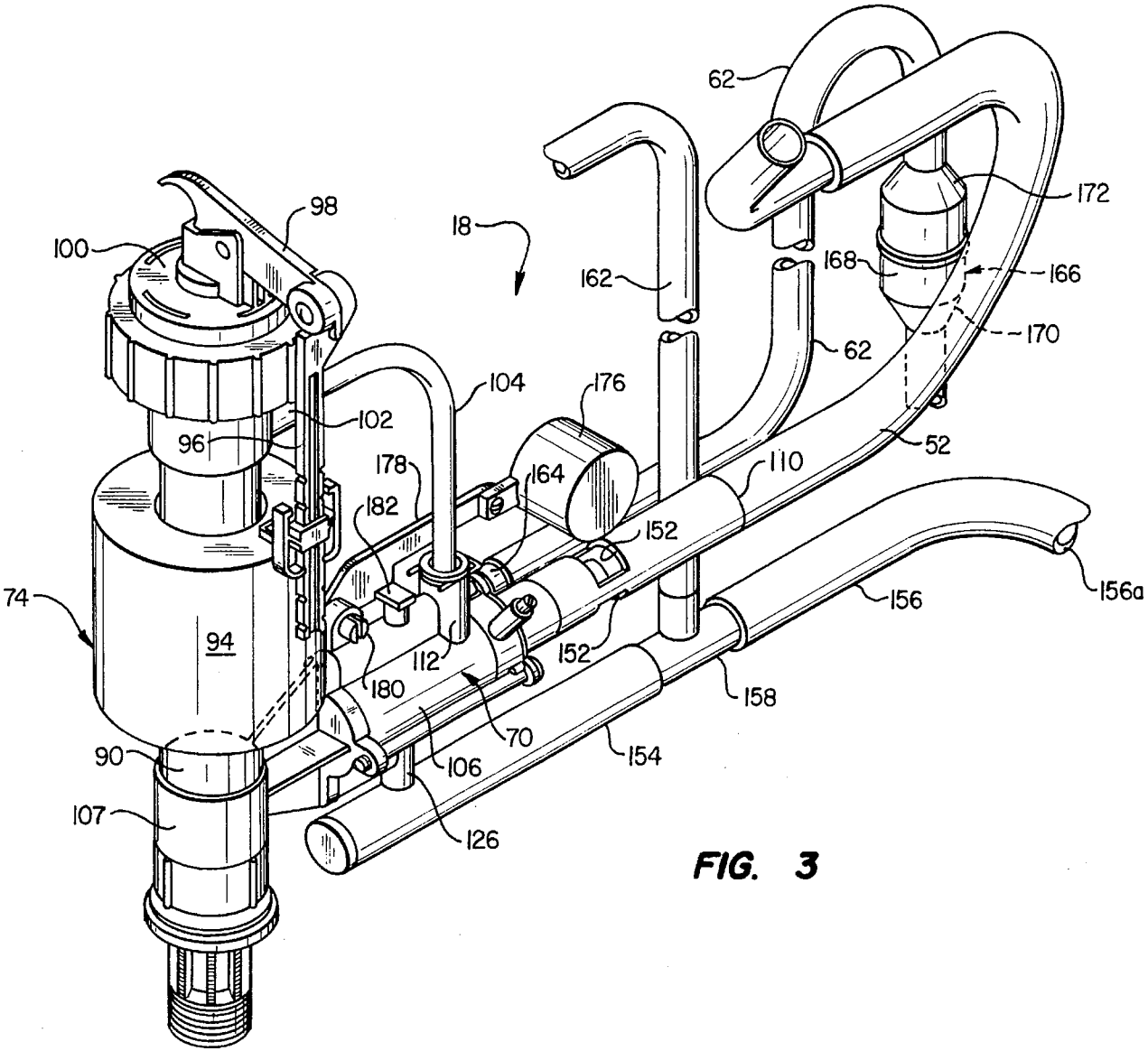
FIG. 3 is an enlarged scale perspective view of a ballcock and diverter valve portion of the flushing system.
Figure 5:
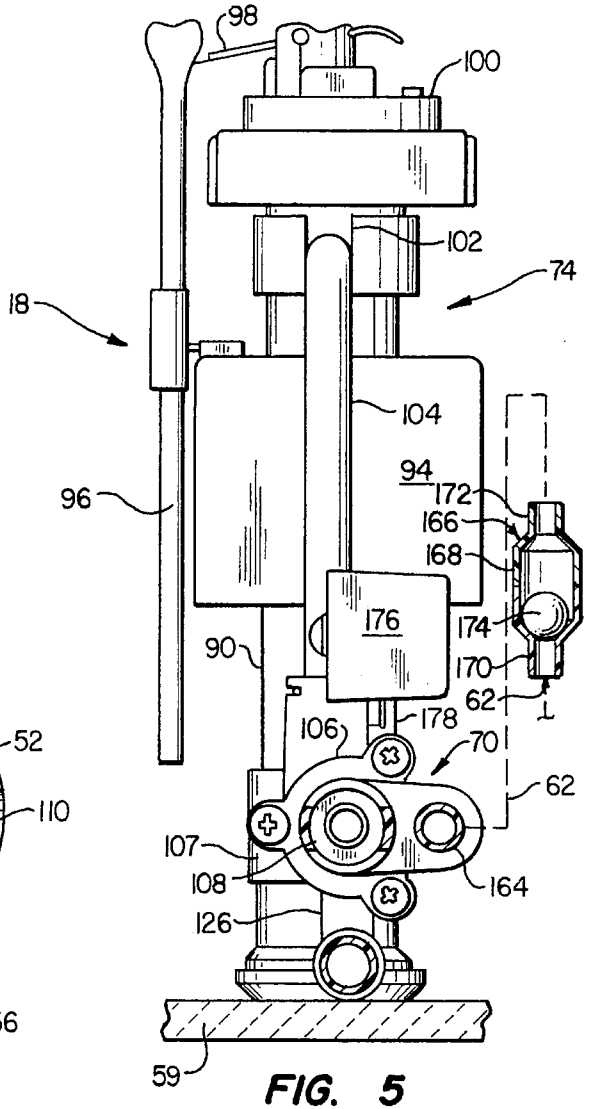
FIG. 5 is a partially schematic side elevational view of the ballcock and diverter valve portion of the flushing system taken generally along line 5—5 of FIG. 4.
Figure 4:
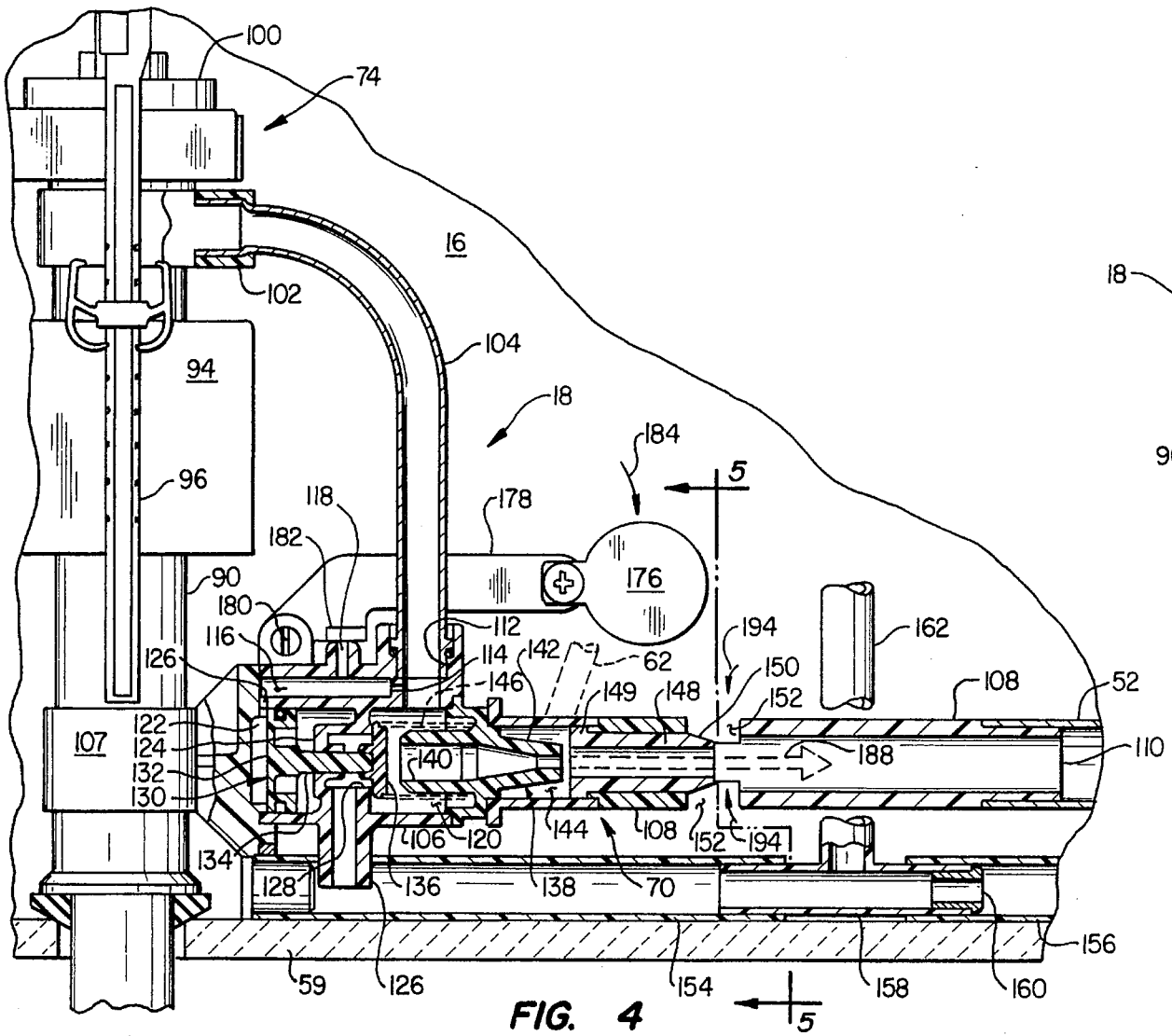
FIG. 4 is a cross-sectional view through a portion of the toilet tank taken generally along line 4—4 of FIG. 1 and illustrating, at an enlarged scale and in partially cutaway side elevation, the ballcock and diverter valve portion of the flushing system.

Turning now to FIGS. 2–5, the water saving, vacuum-assisted flushing system 18 of the present invention includes, within the interior of the tank 16, a specially designed diverter valve 70 operatively associated with a generally conventional flapper valve assembly 72 (see FIG. 2) and a generally conventional ballcock valve assembly 74 (see FIGS. 3–5).

As illustrated in FIG. 2, the flapper valve assembly 72 has a tubular body portion 76 that vertically extends through the bottom tank wall 59 and connects into the upper end of the bowl passageway 58. Secured to the body 76, and communicating with its interior, is a standpipe structure 78 to which a flapper valve 80 is pivotally secured. One end of a trip lever 82 is operatively secured to a flush handle 84 externally mounted on the tank 16, and the other end of the trip lever 82 is connected via a depending chain 86 to an upper side of the flapper valve 80. With the toilet 10 in its pre-flush mode, the trip lever 82 is in its FIG. 2 orientation, and the flapper valve 80 seats on the upper seat end 88 of the valve body 76, thereby preventing tank water from downwardly entering the open upper end of the bowl passageway.

Referring now to FIGS. 3–5, the ballcock valve assembly 74 has a vertically oriented tubular body portion 90 having a lower end portion that sealingly extends downwardly through the bottom tank wall 59 and is connected to a pressurized water supply pipe 92 (see FIG. 1). An annular float member 94 coaxially circumscribes the valve body 90 for vertical movement relative thereto and is anchored to a vertically oriented actuating rod 96. Actuating rod 96 is secured at its upper end to a valve operating lever 98 mounted on the upper end 100 of the valve 74 for driven pivotal movement relative thereto to open and close the valve. Ballcock valve 74 has an outlet 102 to which a downwardly bent water discharge tube 104 is connected.

Still referring to FIGS. 3–5, the interior of diverter valve 70, the conduit 52, the chamber 30 (see FIG. 1), and the rim passage 54 collectively define a second flushing passageway extending through the interior of the tank 16 and having an inlet for receiving pressurized water from a source thereof and an outlet communicated with the interior of the bowl 12 by way of rim jet holes (not shown) formed in the bottom side wall 56 of the rim flushing passage 54.

Diverting valve 70 has a horizontally elongated configuration and generally includes an inlet end portion 106 conveniently secured to the ballcock valve body 90 by means of a mounting collar structure 107, and a tubular outlet end portion 108 having an open, rightwardly facing discharge end 110. The inlet end portion 106 has an inlet opening 112 that sealingly receives the open lower end of the ballcock valve assembly water discharge tube 104.

As cross-sectionally illustrated in FIG. 4, inlet opening 112 leftwardly communicates, via an interior wall port 114, with an internal chamber 116 that in turn is upwardly communicated with the interior of the tank 16 through an exterior valve body wall port 118 that is cross-sectionally larger than the interior port 114. Inlet opening 112 also downwardly communicates with a chamber 120. To the left of chamber 120 is a chamber 122 that is separated from the chamber 120 by an internal wall structure 124 and upwardly communicates with the chamber 116 via an interior wall opening 126. A right side portion of the chamber 122 is appropriately vented to the interior of the tank 16. The chamber 120 communicates with the interior of a tubular outlet portion 126 of the valve 70 via an opening 128 in the internal wall structure 124.

A poppet valve 130 has a cylindrical left head portion 132 slidingly and sealingly received in the chamber 122, a horizontal stem portion 134 slidingly received in an opening in the internal wall structure 124, and a cylindrical right head portion 136 disposed in the chamber 120 and having a diameter smaller than that of head portion 132. A horizontally oriented internal nozzle member 138 has a tubular inlet end 140 positioned in the chamber 120 and facing the poppet valve head portion 136, and a reduced diameter outlet end 142 disposed in a vacuum chamber 144 positioned in a left end of the outlet end portion 108 of the diverter valve 70. A cylindrical return spring element 146 seated as shown between the poppet head 136 and the nozzle 138 leftwardly biases the poppet valve 130 to its FIG. 4 pre-flush orientation in which the poppet head 136 leftwardly engages the wall structure 124 and seals off its opening 128.

To the right of the nozzle 138 within the diverter valve outlet end portion 108 is a tubular reducer fitting 148 which has an inlet end 149 disposed in the vacuum chamber 144 just to the right of the nozzle 138, and an externally tapered outlet end 150 positioned at a circumferentially spaced plurality of side wall tank water inlet openings 152 formed in the outlet end portion 108 of the diverter valve 70. Referring now to FIGS. 3–5, the inlet end of the rim flushing supply conduit 52 is connected to the open discharge end 110 of the valve portion 108, and the tubular outlet portion 126 of the diverter valve 70 is coupled to a plugged left end portion of a conduit 154 which, in turn is coupled to a conduit 156 by two aligned legs of a tee fitting 158 having a reducer fitting 160 received in the leg portion thereof connected to the conduit 156. As best illustrated in FIG. 3, the outer end **156*a* of the conduit 156 is open and disposed within the tank 16. The third leg of the tee 158 is connected to one end of a conduit 162, the other end of which is routed into the open top end of the stand pipe 78 as illustrated in FIG. 2**.

As best illustrated in FIG. 5, the diverter valve 70 has an inlet fitting 164 that communicates with the vacuum chamber 144. One end of the suction conduit 62 is connected to the inlet fitting 164, while the opposite end of the suction conduit 62 is communicated with the top side of the uppermost interior trapway portion 42 as previously described (see FIG. 1). Operatively interposed in the suction conduit 62 (see FIG. 5) is a vertically oriented floating ball type check valve 166 having a hollow cylindrical body 168 with reduced diameter inlet and outlet ends 170 and 172, and an interior floating ball member 174.

A float member 176 is anchored to one end of a lever member 178. The opposite end of lever member 178 is pivotally connected, as at 180, to the top side of the inlet end portion 106 of the diverter valve 70. With the toilet 10 in its pre-flush mode, the float 176 pivots the lever 178 in a counterclockwise direction away from its FIG. 4 orientation in which a transverse stop projection 182 on the lever uncovers the exterior port 118. When the toilet 10 is flushed, and the level of the tank water drops, the lever 178 pivots downwardly in a clockwise direction (as indicated by the arrow 184 in FIG. 4) until the projection 182 stops against the valve inlet portion 106 and blocks the upper end of the port 118 as later described herein.

Operation of the Vacuum-Assisted Flushing System 18

The flushing of the toilet 10 is initiated by turning the handle 84 (see FIGS. 1 and 2) which upwardly pivots the trip lever 82, as indicated by the arrow 186 in FIG. 2, thereby lifting the flapper valve 80 off the seat 88 and allowing tank water to flow downwardly through the passageway 58 (see FIG. 1) and enter the bowl 12 at the outlet 60 of the passageway. As tank water enters the bowl 12, the water level 22 in the bowl rises, thereby causing water to begin flowing rearwardly through the trapway 36 over its internal weir 44.

Referring now to FIGS. 3–5, this discharge of water from the tank 16 causes the ballcock float 94 to descend, thereby forcing the actuating rod 96 downwardly to pivot the lever 98 in a manner opening the ballcock valve 74. Opening of the ballcock valve 74 causes pressurized water to be discharged therefrom and into the diverter valve inlet opening 112 via tube 104. During this initial inflow of pressurized water into the diverter valve 70, the diverter valve float 176 is upwardly pivoted in a counterclockwise direction from its FIG. 4 orientation so that the lever stop projection 182 uncovers the exterior valve port 118.

A small portion of the pressurized water entering the diverter valve 70 is forced leftwardly into the chamber 116 through the interior port 114. However, the water entering chamber 116 does not appreciably pressurize such chamber. Since the port 118 is considerably larger than the port 114, the pressurized water flowing into chamber 116 simply flows outwardly therefrom into the tank interior via the port 118. Additionally, since the pressure in chamber 116 is not appreciably increased, the pressure in the portion of chamber 122 to the left of the poppet head 132 is not appreciably increased. Accordingly, the poppet valve 130 remains in its leftwardly spring-biased position shown in FIG. 4 in which the right poppet head 136 covers the interior wall opening 128 and uncovers the inlet end of the nozzle 138.

The balance of the pressurized water initially entering the diverter valve 70 via the discharge tube 104 enters the valve body chamber 120 and is forced rightly through the nozzle 138 to thereby create a water jet 188 (see FIG. 4) that rightwardly exits the nozzle 138, passes through the reducer fitting 148, and rightwardly enters the balance of the diverter valve outlet end portion 108 to the right of its side wall inlet openings 152.

According to a key aspect of the present invention, the water jet 188 functions to draw a vacuum in the vacuum chamber 144, thereby also creating a vacuum in the uppermost interior portion 42 of the trapway 36 (see FIG. 1), during flushing of the toilet 10, by drawing air from the trapway portion 42 into the diverter valve vacuum chamber 144 through the conduit 62. The floating ball 174 in check valve 166 (see FIG. 5) permits air to be vertically passed through the valve body 168, but prevents upward passage of water through the valve body. The vacuum assist created in the trapway portion 42 by the water jet 188 substantially facilitates the flushing of the toilet 10 with 1.6 total gallons of water. During this vacuum-assisted flushing operation, water flowing downwardly through trapway portion 46 and into trapway portion 48 creates a momentary seal across the trapway interior from approximately first point 190 to second point 192 (see FIG. 1) to further facilitate the vacuum-assisted flushing of the toilet 10.

As the water jet 188 exits the reducer fitting 148 (see FIG. 4) it creates a venturi action inwardly adjacent the tank water inlet openings 152, thereby drawing tank water 194 into the openings 152 and entraining the incoming tank water in the jet 188. The jet water and entrained tank water are then flowed outwardly through the rim flushing conduit 52 and into the annular rim flushing passage 54 (see FIG. 1). Water forced into the passage 54 is discharged therefrom as rim flushing water 196 that, by a wash-down action, augments the main flushing action forcing water outwardly through the trapway 36.

These discharges of tank water cause the floats 94 and 176 to drop within the tank 16. When the diverter valve float 176 drops to the location shown in FIG. 4, the stop projection 182 blocks the outlet port 118 and terminates water outflow therethrough from the chamber 116. This blockage of port 118 permits pressurized ballcock valve supply water being flowed into the chamber 116 via internal port 114 to pressurize the chamber 116 while the water jet 188 is still rightwardly flowing through the diverter valve 70 and the bowl flushing is in progress.

The build-up of pressure in the chamber 116 in turn increases the pressure in the portion of the chamber 122 to the left of the larger poppet head 132 until the poppet valve 130 is pressure driven rightwardly, against the resilient resistance of the biasing spring 146, to cause the smaller poppet head 136 to unblock wall structure opening 128 and then engage and seal off the inlet to the nozzle 138, thereby terminating the water jet 188 and thus the trapway vacuum and the delivery of rim flushing water to the bowl 12.

The poppet valve sealing of the nozzle inlet diverts pressurized water still entering the diverter valve 70 from the ballcock valve 74 leftwardly around the rightwardly shifted poppet head 136 and downwardly through the tubular outlet portion 126 and into the plugged left end portion of the conduit 154 (see FIG. 4). Pressurized water entering the conduit 156 is flowed outwardly through conduit 162 into the upper end of the stand pipe 78 (see FIG. 2), and outwardly through the open end **156*a* of conduit 156 (see FIG. 3), to respectively refill the bowl 12 and the tank 16**.

As the tank is refilled in this manner, the ballcock float 94 and the diverter valve float 176 are upwardly driven until the tank water reaches its pre-flush level 20 at which point the float 94, via the actuating rod 96, closes the ballcock valve 74 to terminate pressurized water flow to the diverter valve 70 and return the toilet 10 to its original pre-flush mode. The termination of pressurized water flow to the diverter valve 70 permits the spring 146 to drive the poppet valve 130 to its original FIG. 4 position.

The vacuum-assisted flushing action achieved using the water jet 188, coupled with the use of the jet to entrain tank water and use the entrained water to augment the rim-washing action of the jet water, uniquely enables the representative tank type toilet 10 to be adequately flushed using only 1.6 gallons of water per flush. Importantly, this low water flushing capability is achieved relatively inexpensively by using the mechanically simple diverter valve 70 which operates in a quiet, reliable fashion. Moreover, it is not necessary in the flushing system 18 of the present invention to reposition the flushing passage outlet opening 60 to the front interior side of the bowl 12.

As will be readily appreciated by those of ordinary skill in this particular art, while the flushing system of the present invention has been representatively illustrated and described in conjunction with a low tank, one piece toilet, the invention could also be advantageously utilized in other types of tank type toilets such as a high tank, two piece toilet. Accordingly, as used herein, phrases such as "tank type toilet" are not limited to the illustrated low tank, one piece toilet.

The foregoing detailed description is to be clearly understood as being given by way of illustration and example only, the spirit and scope of the present invention being limited solely by the appended claims.

What is claimed is:

1. A toilet comprising:

a bowl having an outlet opening;

a water holding tank disposed adjacent said bowl;

a trapway communicating with said outlet opening and forming therewith a flushing discharge passage from said bowl; and flushing means selectively operative to flush said toilet, said flushing means including:

valve means, disposed within said tank, for receiving pressurized water from a source thereof, creating a jet from the received water, utilizing the jet to create a vacuum area within said valve means, and then discharging the received water, first passage means for flowing the discharged water into said bowl, and second passage means for communicating said vacuum area with an interior portion of said trapway in a manner facilitating the flushing of said toilet and reducing its flushing water volume requirement, said flushing means, during flushing of said toilet, operating to lower the water levels in said water holding tank and said bowl, and said valve means being further operative in response to the lowering of the water levels in said water holding tank and said bowl to terminate said jet and divert pressurized water received by said valve means through said valve means and into said water holding tank and said bowl to refill them.

2. The toilet of claim 1 wherein:

said bowl is formed integrally with said water holding tank.

3. The toilet of claim 1 wherein:

said valve means are further operative to cause said jet to entrain tank water therein and deliver the entrained tank water therewith to said bowl through said first passage means.

4. The toilet of claim 3 wherein:

said bowl has a rim portion horizontally circumscribed by a rim flushing passage defining a downstream end portion of said first passage means.

5. The toilet of claim 1 wherein:

said trapway has a weir portion, and an uppermost interior portion disposed above said weir portion, and said second passage means communicate said vacuum area with said uppermost interior portion of said trapway.

6. For use in conjunction with a toilet having a bowl with an outlet opening, a trapway communicating with the outlet opening and forming therewith a discharge passage from said bowl, and a tank positioned adjacent said bowl, a method of flushing the toilet comprising the steps of:

forming a flushing passageway extending through an interior portion of said tank and having an inlet for receiving pressurized water from a source thereof and an outlet communicated with an interior portion of said bowl;

flowing pressurized water through said flushing passageway, from said inlet thereof to said outlet thereof, in a manner creating a water jet therein;

utilizing said water jet to create a vacuum area within said flushing passageway;

communicating said vacuum area with said trapway in a manner drawing air from the interior of said trapway into said vacuum area; and utilizing said flushing passageway to terminate said jet and divert pressurized water received by said flushing passageway through said flushing passageway and into said tank and said bowl to refill them.

7. The method of claim 6 wherein:

the toilet has a rim portion horizontally circumscribed by a rim passage defining a downstream end portion of said flushing passageway, and said method further comprises the steps of entraining tank water in said water jet and flowing the jet water and the entrained tank water into said rim passage.

8. The method of claim 6 wherein:

the trapway has a weir portion, and an uppermost interior portion disposed above the weir portion, and said communicating step is performed by communicating said vacuum area with the uppermost interior trapway portion.

9. The method of claim 6 wherein:

said flushing passageway is a rim flushing passageway, and said method further comprises the steps of forming a bowl flushing passageway extending from an interior portion of the water holding tank to a bottom portion of the bowl, and permitting a gravity flow of tank water into the bowl through said bowl flushing passageway.

10. A toilet comprising:

a bowl having an outlet opening, a rim portion, and a rim passage horizontally circumscribing said rim portion;

a water holding tank disposed adjacent said bowl;

a trapway communicating with said outlet opening and forming therewith a flushing discharge passage from said bowl;

a bowl flushing passageway communicating an interior portion of said water holding tank with a bottom portion of said bowl;

a rim flushing passageway communicating an interior portion of said water holding tank with said rim passage; and flushing means selectively operative to flush said toilet, said flushing means including:

flapper valve means disposed within said water holding tank and operative to momentarily permit a quantity of tank water to flow by gravity through said bowl flushing passageway into said bowl, ballcock valve means disposed within said water holding tank and operative, in response to operation of said flapper valve means, to discharge pressurized water received by said ballcock valve means from a source thereof, diverter valve means disposed within said water holding tank and operative to receive pressurized water from said ballcock valve means, convert the received water into a water jet, utilize the water jet to create a vacuum area within said valve means, and then discharge the received water, first passage defining means for flowing the water jet into said rim flushing passageway, and second passage defining means for communicating said vacuum area with an interior portion of said trapway in a manner facilitating the flushing of said toilet and reducing its flushing water volume requirement, said flushing means, during flushing of said toilet, operating to lower the water levels in said water holding tank and said bowl, and said diverter valve means being further operative in response to the lowering of the water levels in said water holding tank and said bowl to terminate said jet and divert pressurized water received by said diverter valve means through said diverter valve means and into said water holding tank and said bowl to refill them.

11. The toilet of claim 10 wherein:

said bowl is formed integrally with said water holding tank.

12. The toilet of claim 11 wherein:

said toilet is a low tank, one piece toilet.

13. The toilet of claim 10 wherein:

said trapway has a weir portion, and an uppermost interior portion disposed above said weir portion, and said second passage defining means are operative to communicate said vacuum area with said uppermost interior portion of said trapway.

14. The toilet of claim 10 wherein:

said diverter valve means are further operative to cause said water jet to entrain tank water therein and deliver the entrained tank water therewith to said bowl through said first passage defining means.

* * * * *